US008029421B2

(12) United States Patent
Commeau

(10) Patent No.: US 8,029,421 B2
(45) Date of Patent: Oct. 4, 2011

(54) REACTIVE PUNCHING BAG DEVICE

(76) Inventor: Jeffery Commeau, Fall River, MA (US)

( * ) Notice: Subject to any disclaimer, the term of this patent is extended or adjusted under 35 U.S.C. 154(b) by 0 days.

(21) Appl. No.: 12/249,136

(22) Filed: Oct. 10, 2008

(65) Prior Publication Data

US 2010/0093503 A1 Apr. 15, 2010

(51) Int. Cl.
*A63B 21/00* (2006.01)

(52) U.S. Cl. ..... 482/83; 482/126; 482/87; 482/89

(58) Field of Classification Search ..... 482/91, 482/148, 126, 102, 100, 83–90
See application file for complete search history.

(56) References Cited

U.S. PATENT DOCUMENTS 5,190,512 A * 3/1993 Curran ..... 482/124
5,588,942 A * 12/1996 Dillard ..... 482/139
5,868,651 A * 2/1999 Washington ..... 482/91
5,902,217 A * 5/1999 Schechner et al. ..... 482/83

* cited by examiner

*Primary Examiner* — Jerome W Donnelly

(57) ABSTRACT

A reactive punching bag device is provided. The reactive punching bag device includes a first telescoping pole and a second telescoping pole. The telescoping poles are via a center pole which may include at least one quick release hook. The connected pole assembly is connectable to a heavy punching bag, or any suitable bag, and provides a reactive obstacle to a trainee developing defensive and offensive skills. In addition, the heavy bag may include at least one attachment chain for hanging the heavy bag. The pole assembly may also include a first and second pole connectable to a center pole by elastic cord through the center of the poles.

3 Claims, 2 Drawing Sheets

REACTIVE PUNCHING BAG DEVICE

BACKGROUND

1. Field of Use

The present invention is related to exercise and athletic training apparatus and more particularly to athletic training bags useful in developing defensive techniques.

2. Description of Prior Art (Background)

It will be appreciated that offensive martial art or boxing techniques (striking) should be executed while simultaneously observing proper defensive form and proper defensive techniques. Defensive techniques include footwork, moving side to side, bobbing, weaving and blocking. Offensive techniques (striking) should be executed while simultaneously observing proper defensive form and techniques. Striking a heavy bag only gives the athlete practice for offensive striking and may lead to a lax defensive posture and could lead to poor defensive technique. However, as described herein, prior art boxing or martial arts apparatus either do not allow for simultaneous offensive and defensive training, or are complicated and un-adjustable systems.

For example, in U.S. Pat. No. 5,700,229 a kicking target, or "martial arts" target is shown, which is composed of a fabric reinforced synthetic rubber tubing member that is equipped with a piece of hollow plastic pipe material inserted within, such as poly-vinyl-chloride or other rigid material. The plastic pipe material is filled with sand and capped at both ends. The target is equipped with loops of steel cable at both ends to allow it to be attached to various stationary objects, or to be combined with other targets of die same design, for example, to form a circular shape. Such features are said to provide for a target strong enough to withstand long-term and severe use, and which also possesses the desired energy absorbing characteristics. However, this type of poaching bag only allows for offensive training.

In another example of conventional punching bags, U.S. Pat. No. 4,434,980 describes an arrangement in which a boxing device that "fights back" is comprised of a coupling suspended from a rigid upper supporting structure with resilient boxing bags suspended from the coupling and attachable to a rigid lower supporting structure. A pair of fixed length "arms" are also provided with this arrangement with their upper ends attached to the upper coupling, and with their lower ends free to swing forwards and towards an "attacker" in response to blows upon the bag. It will be appreciated this arrangement is complicated and non-adjustable.

It will be appreciated that there exists a need for a reactive punching bag allowing for the athlete to practice both defensive and offensive techniques simultaneously.

BRIEF SUMMARY

As will be described below, important aspects of the invention reside in the invention's features overcoming the shortfalls of the prior art.

In accordance with one embodiment of the invention a reactive punching bag device is provided. The reactive punching bag device includes a first telescoping pole and a second telescoping pole. The telescoping poles are via a center pole. The connected pole assembly is connectable to a heavy punching bag, or any suitable bag, and provides a reactive obstacle to a trainee developing defensive and offensive skills.

The invention is also directed towards a striking bag assembly. The striking bag assembly includes a heavy bag and at least one attachment chain for hanging the heavy bag. The striking bag assembly also includes a pole assembly connectable to the attachment chain. The pole assembly includes a first and second pole connectable to a center pole by elastic cord through the center of the poles.

The invention is also directed towards another striking bag assembly including a heavy bag and at least one attachment chain for hanging the heavy bag. The striking bag assembly also includes at least one pole assembly connectable to the at least one attachment chain, wherein the at least one pole includes at least one first telescoping pole and at least one second telescoping pole. The first and second poles are connectable via a center pole. The center pole includes at least one quick release hook.

DETAILED DESCRIPTION

Figure 1:
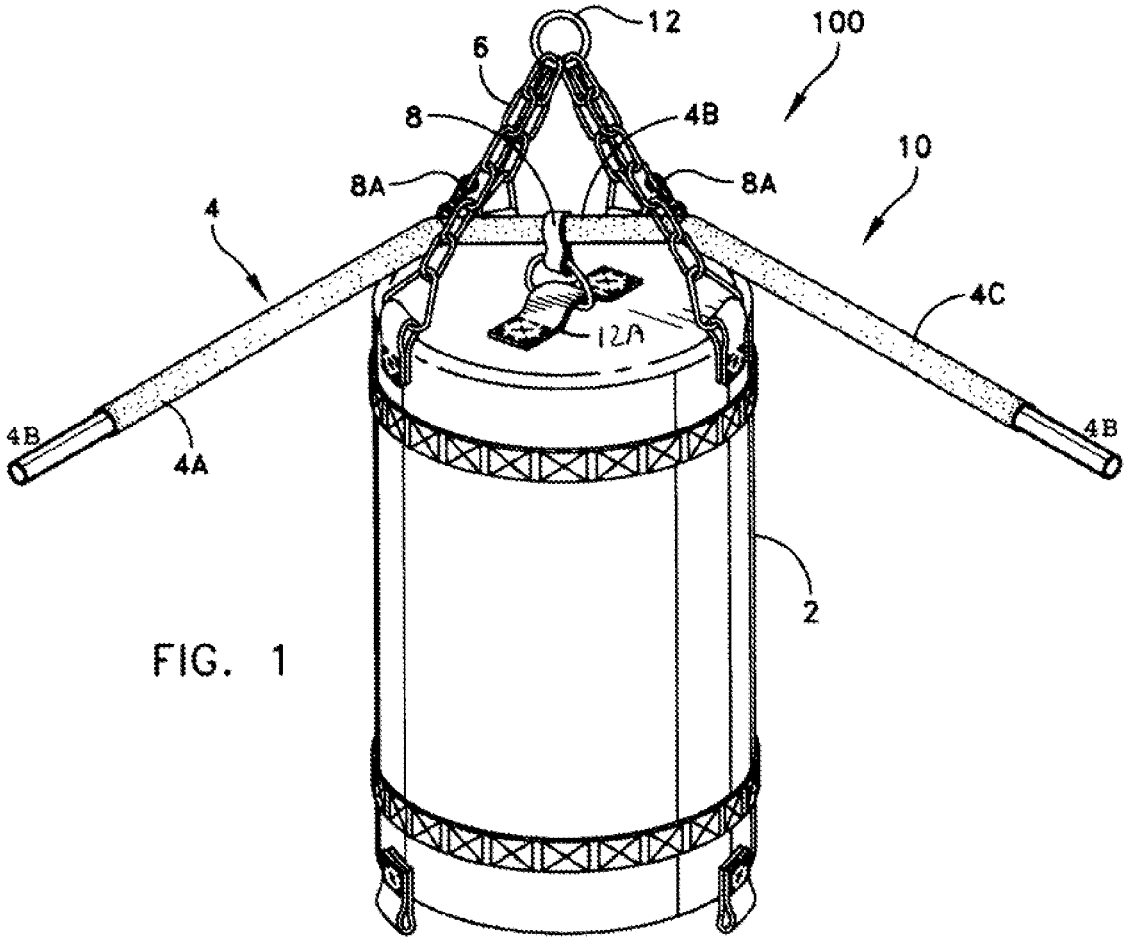
FIG. 1 is a side perspective view of a reactive punching bag device incorporating features of the present invention.

Referring to FIG. 1 there is shown a side perspective view of a reactive punching bag device incorporating features of the present invention. Although the present invention will be described with reference to embodiments shown in the drawings, it should be understood that the present invention can be embodied in many alternative embodiments. In addition, any suitable size, shape or type of elements or materials could be used. Still referring to FIG. 1 there is shown a reactive punching bag device 100. Reactive punching bag device includes defensive assembly 10, heavy bag 2, attachment chains 6, securing ring 12, securing strap 12A, defensive assembly securing strap 8, and defensive assembly 10 securing devices 8A.

Still referring to FIG. 1 it will be appreciated that heavy bag 2 may be any suitable punching bag commonly available. It will also be appreciated that heavy bag 2 may have one or more of the securing devices shown in FIG. 1. For example, heavy bag 2 may not have securing strap 12A; or may have securing strap 12A but not attachment chains 6 such is in a floor model heavy bag.

Figure 2:
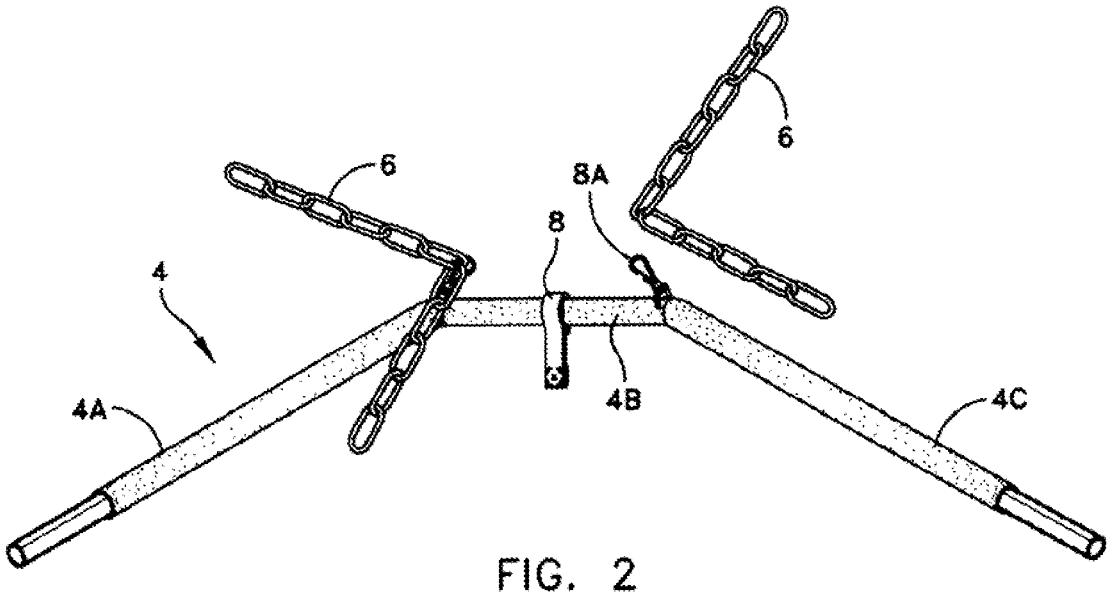
FIG. 2 is an exploded perspective view of the reactive device shown in FIG. 1.

Referring also to FIG. 2 there is shown defensive assembly 10. Defensive assembly 10 includes pole assembly 4. Pole assembly 4 includes left telescoping pole 4A, center pole section 4B, and right telescoping pole section 4C. Left telescoping pole 4A may be any suitable pole material adjustable in length. Optionally, left telescoping pole 4A may be encased in a suitable material such as impact foam or rubber casing to minimize user injury. Similarly, right telescoping pole 4A may be any suitable pole material adjustable in length. Optionally, right telescoping pole 4A may be encased in a suitable material such as impact foam or robber casing to minimize user injury. It will, be understood right telescoping pole 4A and left telescoping pole 4C may telescope from and to any suitable length. Left and right telescoping poles, 4A and 4C, respectively, provide reactive movement to be avoided when the poles or bag are struck.

Still referring to FIG. 2, pole assembly 4 also includes center pole 4B. Center pole 4B may be any suitable length connectable to right telescoping pole 4A and left telescoping pole 4C. Similarly center pole 4B may also be encased or padded with a suitable material such as impact foam or rubber casing to minimize user injury.

Still referring to FIG. 2, defensive assembly 10 also includes defensive assembly securing strap 8, and defensive assembly 10 securing devices 8A. Securing strap 8 may be any suitable securing device such as, for example, a hook-loop (e.g., Velcro™) strap, suitable rope, or plastic tie-wraps.

Figure 4:
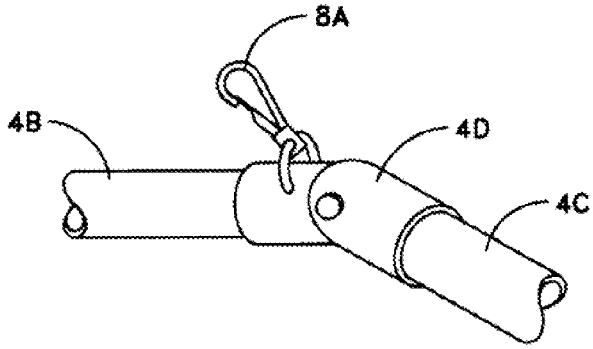
FIG. 4 is a side exploded perspective view of the invention shown in FIG. 2 using adjustable elbows.

Securing devices 8A shown in FIG. 2 may be any suitable connector such as a quick release connector shown in FIG. 4.

Figure 3:
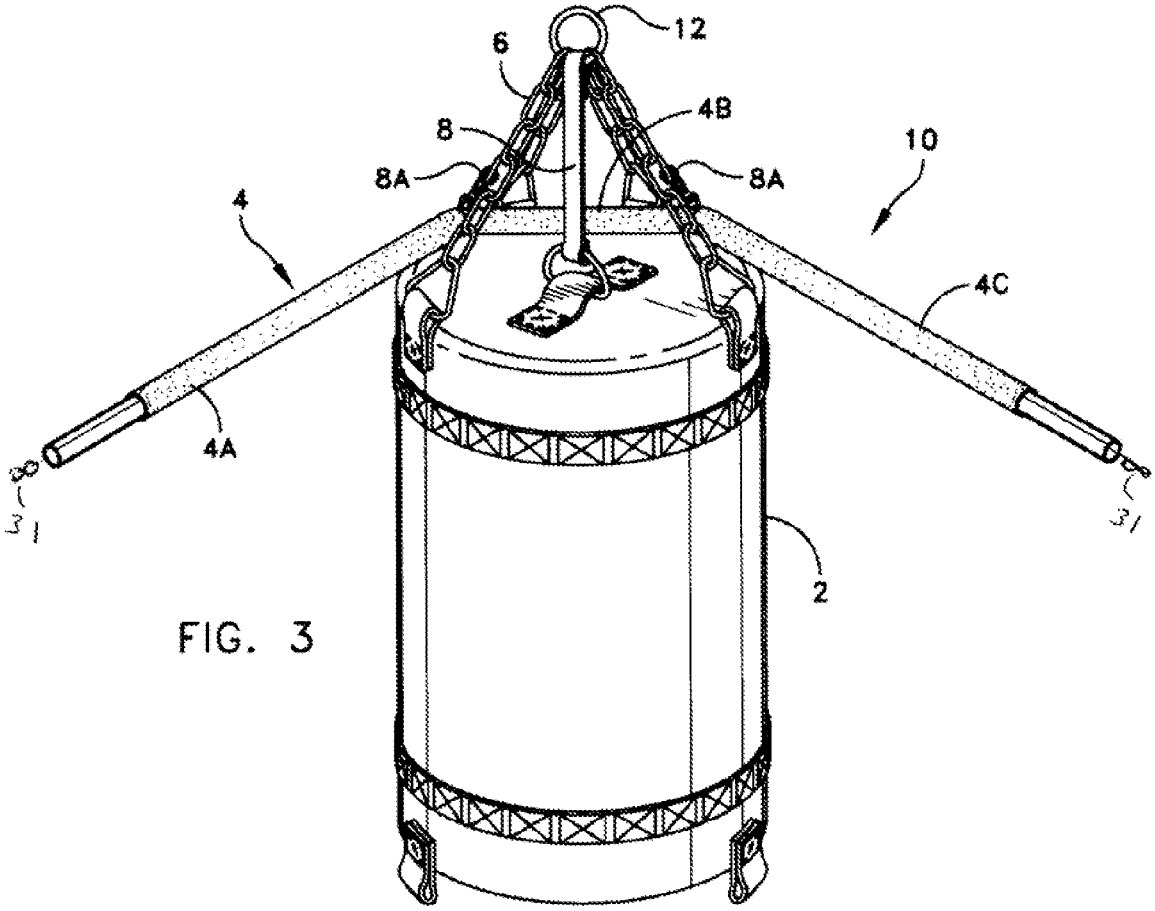
FIG. 3 is an exploded perspective view of an alternate embodiment of the invention shown in FIG. 1.

Referring also to FIG. 3 there is shown an exploded perspective view of an alternate embodiment of die invention shown in FIG. 3. In this embodiment, heavy bag 2 and center pole 48 and may optionally be supported by strap 8. It will be understood that the attachment arrangements discussed herein, i.e., securing strap 8, chains 6, and securing devices 8A may be used together or as desired. Also shown is elastic cord 31. Elastic cord 31 may be a single cord running from one end of left telescoping pole 4A, through telescoping pole 4A, through center pole 4B, through right telescoping pole 4C, to end of telescoping pole 4B. It will be appreciated, that elastic cord 31, knotted at both ends couples left and right telescoping poles with center pole 4B and provides kinetic reaction energy when the heavy bag is struck or the left or right poles are struck.

Referring also to FIG. 4 mere is shown a side exploded perspective view of the invention shown in FIG. 2 where center pole 4B is connectable to right telescoping pole 4C via adjustable coupling or elbow 4D. It will be appreciated that left telescoping pole is also connectable to center pole 4B via a similar adjustable elbow. Adjustable elbow 4D may be any suitable connecting device allowing for suitable angle offset between center pole 4B and right telescoping pole 4C.

It will be appreciated that the invention described herein provides a device for developing offensive martial art or boxing techniques (striking) while simultaneously observing proper defensive form and proper defensive techniques. Defensive techniques include footwork, moving side to side, bobbing, weaving and blocking left and/or right telescoping poles 4A and 4B, respectively. Offensive techniques (striking bag 2) can be executed while simultaneously observing proper defensive form and techniques.

What is claimed is:

1. A striking bag assembly comprising:

a heavy bag;

at least one attachment chain for hanging the heavy bag;

at least one pole assembly connectable to the at least one attachment chain, wherein the at least one pole assembly comprises:

at least one first telescoping pole;

at least one second telescoping pole; and at least one center pole connectable to the at least one first telescoping pole and the at least one second telescoping pole, wherein the at least one center pole comprises at least one securing device wherein the at least one securing device comprises at least one quick release hook.

2. The striking bag as in claim 1 wherein the at least one center pole comprises at least one adjustable coupling.

3. A reactive punching bag apparatus especially adapted for use in association with and while mounted adjustably and removable to a punching bag, the apparatus comprising:

a heavy punching bag;

at least one first telescoping pole;

at least one second telescoping pole;

at least one removable securing device for mounting the reactive punching bag device apparatus to the punching bag: and at least one center pole connectable to the at least one first telescoping pole and the at least one second telescoping pole by elastic cord, wherein the at least one center pole comprises at least one securing device for securing the reactive punching bag device to the punching bag, whereby when the punching bag apparatus is mounted to the punching bag the at least one first telescoping pole and the at least one second telescoping pole provide reactive kinematic movement of the telescoping poles to be avoided when the at least one first telescoping pole, the at least one second telescoping pole, or the punching bag are struck.

* * * * *